US009061805B2

(12) United States Patent
Adams

(10) Patent No.: US 9,061,805 B2
(45) Date of Patent: Jun. 23, 2015

(54) METHOD AND APPARATUS FOR COOLING AND TRANSPORTING A BEVERAGE

(71) Applicant: Brandon Adams, Garnavillo, IA (US)

(72) Inventor: Brandon Adams, Garnavillo, IA (US)

( * ) Notice: Subject to any disclaimer, the term of this patent is extended or adjusted under 35 U.S.C. 154(b) by 65 days.

(21) Appl. No.: 13/934,404

(22) Filed: Jul. 3, 2013

(65) Prior Publication Data

US 2014/0010938 A1 Jan. 9, 2014

Related U.S. Application Data

(60) Provisional application No. 61/668,481, filed on Jul. 6, 2012.

(51) Int. Cl.

| | |
|---|---|
| ***B65D 3/00*** | (2006.01) |
| ***B65D 51/28*** | (2006.01) |
| ***B65D 81/36*** | (2006.01) |
| ***B65D 47/08*** | (2006.01) |
| ***B65D 47/26*** | (2006.01) |

(52) U.S. Cl.

CPC ..... *B65D 51/2807* (2013.01); *B65D 81/365* (2013.01); *B65D 47/0842* (2013.01); *B65D 47/263* (2013.01); *F25D 2303/08* (2013.01)

(58) Field of Classification Search

CPC ..... A61J 3/08; B65D 1/30

USPC ..... 246/58, 94, 96, 97, 141, 203; 206/529, 206/528; 215/258, 306; 62/457.3, 371, 62/457.2; 249/58, 94, 96, 97, 141, 203

See application file for complete search history.

(56) References Cited

U.S. PATENT DOCUMENTS

| | | | | |
|---|---|---|---|---|
| 2,932,386 | A * | 4/1960 | Ushkow | 249/127 |
| 3,104,665 | A * | 9/1963 | Towns | 604/288 |
| 3,565,389 | A * | 2/1971 | Price | 249/121 |
| 4,595,549 | A * | 6/1986 | Inouye et al. | 264/267 |
| 5,129,238 | A * | 7/1992 | Schwartz et al. | 62/457.3 |
| 5,609,039 | A * | 3/1997 | Green et al. | 62/457.3 |
| 7,185,782 | B2 * | 3/2007 | Vilchez et al. | 220/506 |
| 7,415,839 | B2 * | 8/2008 | Robertson et al. | 62/464 |
| 7,691,626 | B2 * | 4/2010 | McCabe et al. | 435/307.1 |
| 2005/0064069 | A1 | 3/2005 | Adams | |
| 2005/0210911 | A1 * | 9/2005 | Dyrbye et al. | 62/457.3 |
| 2005/0247714 | A1 * | 11/2005 | Backes et al. | 220/375 |

* cited by examiner

*Primary Examiner* — Steven A. Reynolds
*Assistant Examiner* — King M Chu
(74) *Attorney, Agent, or Firm* — Zarley Law Firm, P.L.C.

(57) ABSTRACT

A device for cooling and flavoring a beverage having a tube with a closed first end and an open second end. Between the first and second end is a plurality of openings. A cap is removably attached to the open end. A cover strip is attached to the cap and extends into the tube such that as the cap is rotated in relation to the tube, the cover strip selectively covers and uncovers the plurality of openings.

18 Claims, 3 Drawing Sheets

METHOD AND APPARATUS FOR COOLING AND TRANSPORTING A BEVERAGE

CROSS REFERENCE TO RELATED APPLICATION

This application claims the benefit of U.S. Provisional Application No. 61/668,481 filed Jul. 6, 2012.

BACKGROUND OF THE INVENTION

This invention relates to devices for cooling beverages and forming ice and more particularly to a method and device that not only forms ice, but that can also be placed in a beverage container.

Devices forming ice and cooling beverages are well known in the art but what is desired is a device that will do both. With devices that form ice for placement in a beverage, as the ice melts the beverage is diluted affecting the taste. Devices for cooling a beverage either are not formed for use with many bottled beverages or contain chemicals which could be harmful if leaked. Further, these devices do not permit for adding flavor to a beverage or mixing multiple liquids. Thus, a need exists in the art for a device and method that address these deficiencies.

Therefore, an objective of the present invention is to provide a method and device that more efficiently cools a beverage.

Another objective of the present invention is to provide a method and device that forms ice for use with bottled beverages.

A still further objective is to provide a device and method that provides easy transport of liquid for mixing.

These and other objectives will be apparent to one of ordinary skill I the art based upon the following written description, drawings, and claims.

SUMMARY OF THE INVENTION

A device for cooling and flavoring a beverage having a tube with a closed first end and an open second end. Between the first and second end is a plurality of openings. A cap is removably attached to the open end. A cover strip is attached to the cap and extends into the tube such that as the cap is rotated in relation to the tube, the cover strip selectively covers and uncovers the plurality of openings.

DETAILED DESCRIPTION OF THE PREFERRED EMBODIMENT

Figure 1:
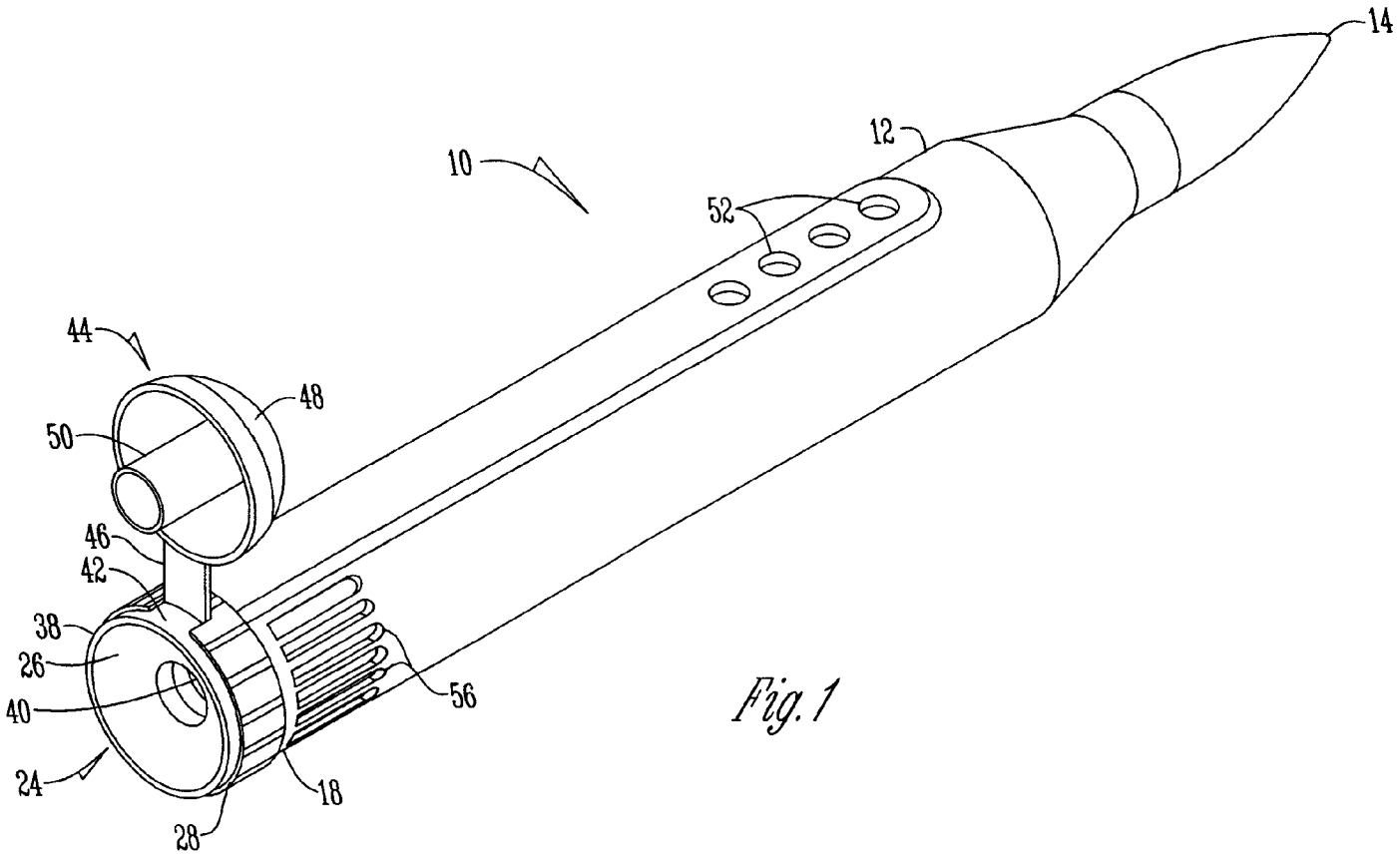
FIG. 1 is a perspective view of a beverage cooling and flavoring device.

Referring to the Figures, the cooling device 10 includes a hollow elongated tube 12 that is closed at a first end 14 and has an opening 16 at the opposite end 18. The tube 12 is of any shape and in one embodiment the first end 14 is tapered such that the tube 12 looks like a bullet. Adjacent end 18, on the outer surface 20 of tube 12 are threads 22.

Removably attached to end 18 of tube 12 is a cap 24. The cap 24 has an end wall 26 and a side wall 28 that form a hollow chamber 30. On the inner surface 32 of the side wall 28 are threads 34 that are matingly received by threads 22. While, as an example, the cap is threadably mated to the tube, alternatively the cap is attached to the tube in any conventional manner such as a snap fit, by friction, or the like. Preferably, the cap 24 has a diameter of 0.69 inches and the tube 12 has a diameter of 0.54 inches, such that the device 10 will fit within the opening of a beverage container. In an alternative embodiment, the end wall 26 tapers downwardly from an outer edge 38 to a central opening 40 to form a funnel shape. Attached to an outer surface 42 of the cap 24 is a plug 44 having a pliable strap 46 that is connected to and extends outwardly from the outer surface 42 of the cap 24. A head portion 48 is attached to the strap 46 and a stem 50 extends outwardly from the head portion 48. Preferably, the head portion 48 is shaped as a partial sphere and has a diameter that engages the outer edge 38 of the cap 24 when flipped to a closed position. Also, the stem 50 is positioned such that it is received within central opening 40 when in a closed position.

Figure 2:
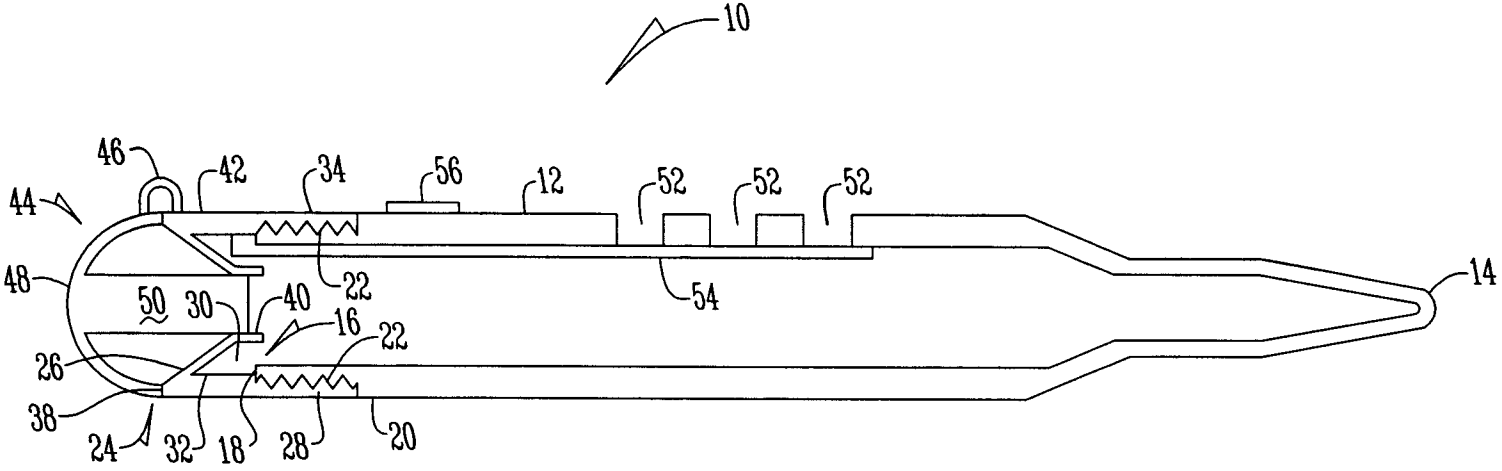
FIG. 2 is a side sectional view of a beverage cooling and flavoring device.
Figure 3:
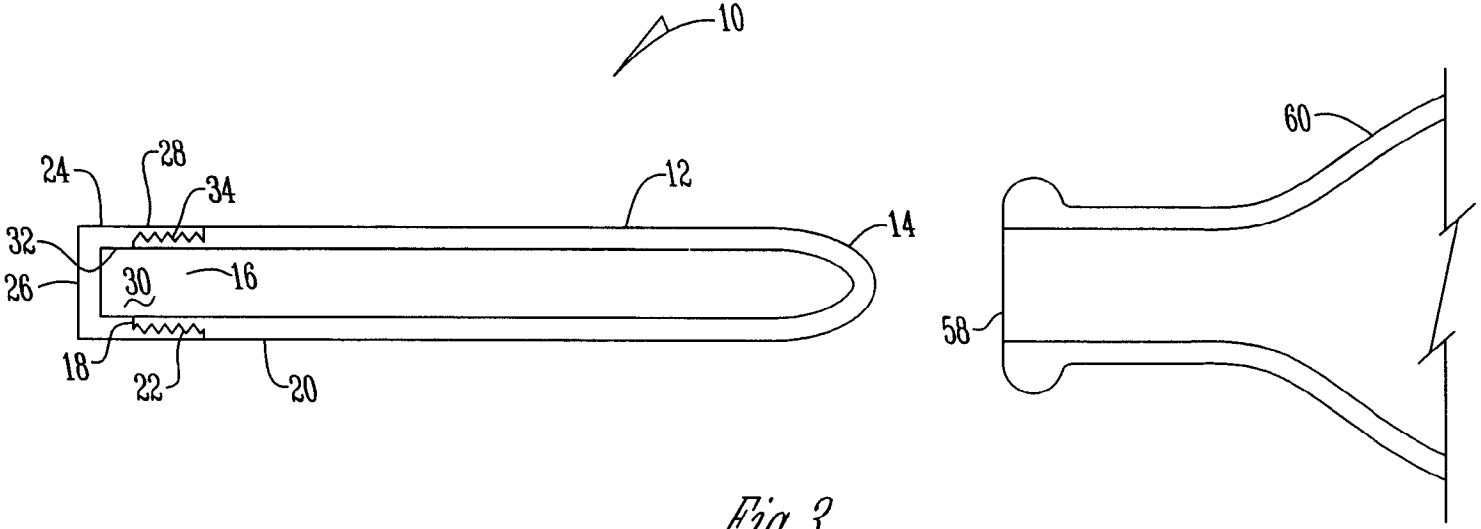
FIG. 3 is a side sectional view of a beverage cooling and flavoring device.

Positioned between the first end 14 and the second end 18 of the tube 12 is at least one, and preferably a plurality of openings 52. Preferred is that the openings 52 are in elongated alignment along the length of the tube 12. Attached to the inner surface 32 of the sidewall 28 of the cap 24 is a closing strip 54. The closing strip 54 extends from the cap 24 into the tube 12 and is positioned to selectively cover and uncover the openings 52 as the cap 24 is rotated from one position to another position. To assist in turning the cap 24, a plurality of gripping protrusions 56 extend outwardly from the tube 12 adjacent the second end 18. In one arrangement, the gripping protrusions 56 are depressions to facilitate turning the cap rather than protrusions. The gripping protrusions 56, as shown in FIG. 2, are located along side openings 52 and along closing strip 54. In another arrangement, as shown in FIG. 1, the gripping protrusions or depressions 56 are located along the side opening 52 and not the closing strip 54.

In operation, the device 10 is filled with a liquid such as water, flavored water, flavoring, or an alcoholic beverage. Once filled, the cap 24 is threaded onto end 18 of tube 12 to close and seal opening 16. To form ice and/or to cool a beverage, the device 10 is placed in a refrigerated space until the liquid freezes or is cooled. Once frozen or cooled, the cap 24 is removed from 12 and the formed ice is removed and then inserted through the opening 58 of the beverage container 60. Alternatively, to avoid diluting the beverage as the ice melts, the device 10, with the cap 24 on tube 12, is inserted through opening 58 of container 60. As another alternative, the cap 24 is removed from tube 12 and tube 12 is inserted through opening 58 of container 60.

To use the device 10 to mix drinks, the liquid is either poured from tube 12 through opening 58 or the tube 12 without the cap 24 is inserted through opening 58 of container 60.

In yet another embodiment, the tube 12 is filled with a desired liquid with a cap 24 having a cover strip 54 positioned to cover openings 52. The tube 12 is filled by pouring liquid through the central opening 40. Once filled the stem 50 of the plug 44 is placed in the central opening 40 to close the tube 12 for cooling and/or freezing. To cool and flavor a drink, the cap 24 is rotated such that the cover strip 54 no longer is covering openings 52. The tube 12 is then inserted through opening 58 of container 60. As the liquid melts, it flows through openings 52 to cool and flavor the drink. Should one just wish to cool a drink, the cover strip 54 is left in a position that covers openings 52.

Thus a device and method have been disclosed that at the very least meets the stated objectives.

What is claimed:

1. A device for cooling and flavoring a beverage comprising;

an elongated tube having a closed first end and an opening at a second end and at least one opening between the first end and the second end;

a cap removably attached to the second end of the tube such that the cap covers the opening at the second end;

wherein the tube has a diameter that fits within an opening of a beverage container; and a cover strip attached to the cap and extending into the tube so at to selectively cover and uncover the at least one opening.

2. The device of claim 1 wherein the cap has a central opening that receives a stem of a plug.

3. The device of claim 1 further comprises the second end having threads on an outer surface and the cap having threads that matingly receive the threads on the second end.

4. The device of claim 1 wherein the cap has a diameter of 0.69 inches.

5. The device of claim 1 wherein the tube has a diameter of 0.54 inches.

6. The device of claim 1 wherein the tube tapers downwardly from the first end to the second end.

7. The device of claim 1 wherein a plurality of gripping protrusions extend outwardly from the tube.

8. The device of claim 7 wherein the plurality of gripping protrusions are adjacent the second end.

9. The device of claim 1 wherein a plurality of gripping depressions are positioned adjacent the second end.

10. The device of claim 2 further comprising a strap attached to an outer surface of the cap at one end and a head portion on the opposite end.

11. The device of claim 10 wherein the head portion is shaped like a partial sphere.

12. The device of claim 10 further comprising a stem extending outwardly from the head portion.

13. The device of claim 10 wherein the head portion has a diameter that engages an outer edge of the cap when in a closed position.

14. The device of claim 1 wherein the tube is funnel shaped.

15. The device of claim 1 wherein the tube is bullet shaped.

16. The device of claim 1 wherein the cap is rotated to move the cover strip away from the at least one opening.

17. A device for cooling and flavoring a beverage comprising;

an elongated tube having a closed first end and an opening at a second end and a plurality of openings between the first end and the second end;

a cap removably attached to the second end of the tube such that the cap covers the opening at the second end;

wherein the tube has a diameter that fits within an opening of a beverage container; and a cover strip attached to the cap and extending into the tube so as to selectively cover and uncover the plurality of openings.

18. The device of claim 17 wherein the plurality of openings are in elongated alignment along the length of the tube.

* * * * *